US005733210A

United States Patent [19]

Yiu

[11] Patent Number: 5,733,210

[45] Date of Patent: Mar. 31, 1998

[54] APPARATUS FOR SCORING TABLE TENNIS GAME

[76] Inventor: Chih-Hao Yiu, 7F-1, No. 30, Lin Sen Road, Taichung, Taiwan

[21] Appl. No.: 620,558

[22] Filed: Mar. 25, 1996

[51] Int. Cl.[6] ..... A63B 63/00

[52] U.S. Cl. ..... 473/475; 473/496

[58] Field of Search ..... 473/490, 496, 473/467, 473, 475; 116/222; 340/323 R

[56] References Cited

U.S. PATENT DOCUMENTS 4,109,911 8/1978 Van Auken ..... 473/467
4,422,647 12/1983 Wilson et al. ..... 473/467
5,348,309 9/1994 Queiros ..... 473/467
5,566,936 10/1996 Newgarden et al. ..... 473/475

*Primary Examiner*—William E. Stoll
*Assistant Examiner*—James Schaaf
*Attorney, Agent, or Firm*—Charles E. Baxley, Esq.

[57] ABSTRACT

A scoring apparatus for scoring a table tennis game includes three sensors secured to two tables and a net device of the table tennis game for sensing the striking of a table tennis ball to the tables and to the net device. A processing device is coupled to the sensors for receiving signals from the sensors, and a displayer device is coupled to the processing device for displaying the scores of the players. The displayer device includes two displayer screen fors displaying the scores of two players. The displayer device includes one or more press buttons for calibrating the displayer screens.

5 Claims, 4 Drawing Sheets

APPARATUS FOR SCORING TABLE TENNIS GAME

BACKGROUND OF THE INVENTION

1. Field of the Invention

The present invention relates to a scoring apparatus, and more particularly to an apparatus for scoring a table tennis game.

2. Description of the Prior Art

Typical table tennis games are scored by the players or by another person watching the game. However, the players may not concentrate their mind on the table tennis game.

The present invention has arisen to mitigate and/or obviate the afore-described disadvantages of the conventional table tennis games scoring methods.

SUMMARY OF THE INVENTION

The primary objective of the present invention is to provide an apparatus which may automatically score the table tennis games.

In accordance with one aspect of the invention, there is provided a scoring apparatus for scoring a table tennis game, the scoring apparatus comprising three sensors for securing to two tables and a net device of the table tennis game respectively and for sensing a striking of a table tennis ball to the tables and to the net device, a processing means coupled to the sensors or receiving signals from the sensors and for processing the signals, and a displayer means coupled to the processing means for displaying a score of the table tennis game.

The processing means includes an amplifier device for amplifying the signals from the sensors and includes a rectifyer device for rectifying the amplified signals, and includes an identify device for identifying the rectified signals.

The displayer means includes a first displayer screen for displaying the score of a first player and includes a second displayer screen for displaying the score of a second player.

The displayer means further includes a third displayer screen for displaying a number of balls to be served.

The displayer means further includes at least one press button for calibrating the first and the second displayer screens.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
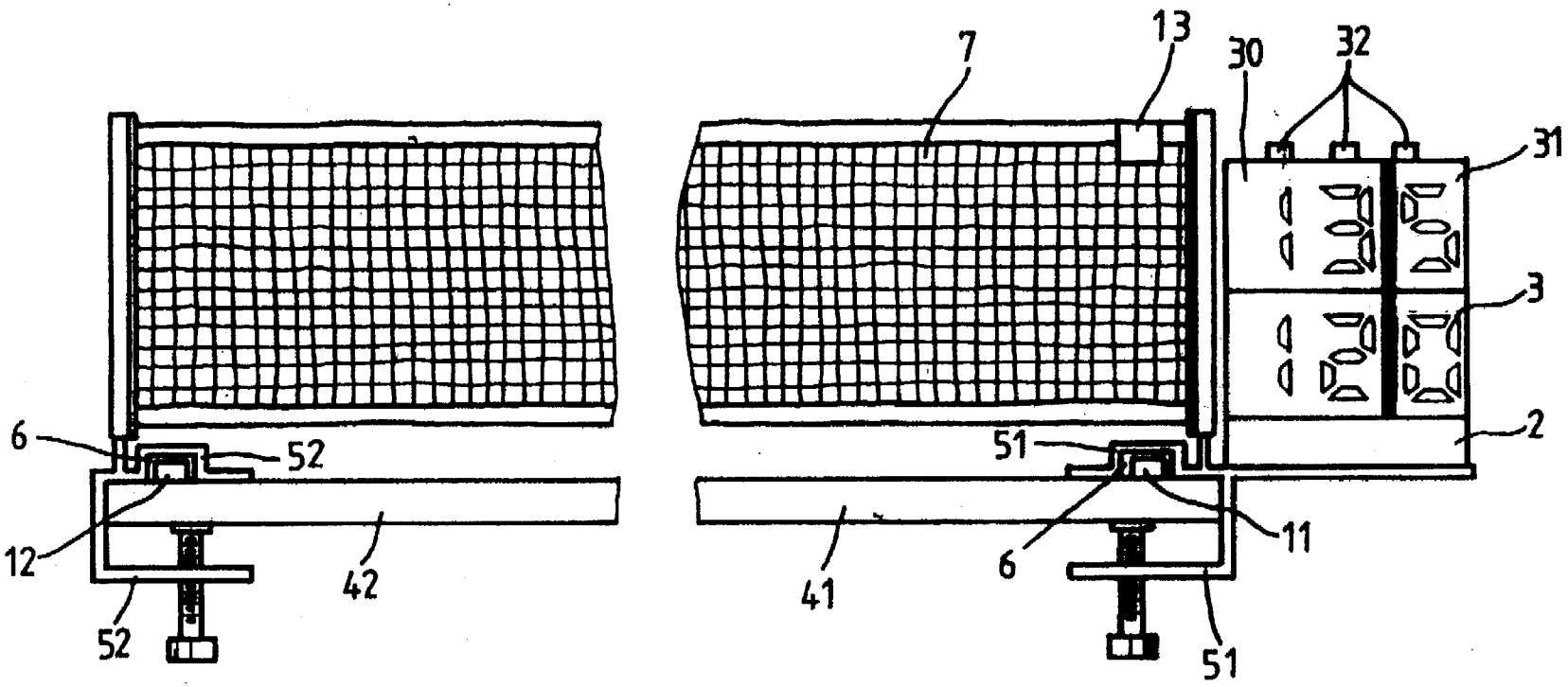
FIG. 1 is a schematic view of a table tennis scoring apparatus in accordance with the present invention.
Figure 2:
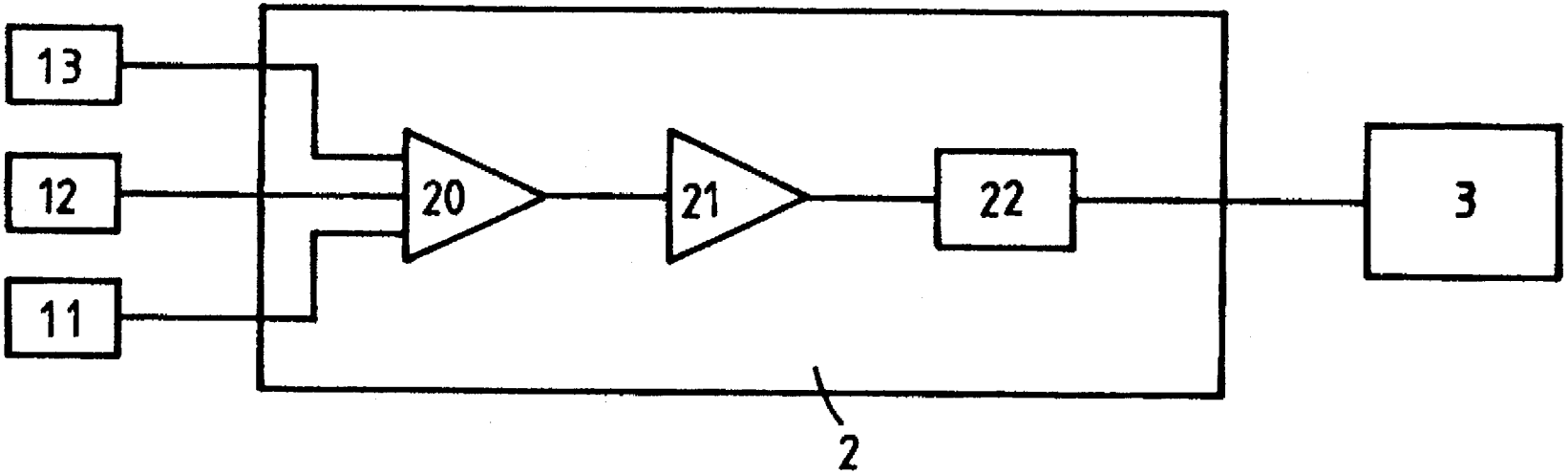
FIG. 2 is a block diagram of the table tennis scoring apparatus.

Referring to FIGS. 1 and 2, a table tennis automatic scoring apparatus in accordance with the present invention comprises two sensors 11, 12 secured on the two tables 41, 42 of the typical table tennis games by clamping devices 51, 52 respectively. Two pad devices 6 are engaged between the sensors 1l, 12 and the clamping devices 51, 52 respectively for protecting the sensors 11, 12. The sensors 11, 12 are provided for sensing the hitting sound of the ball of the table tennis game onto the tables 41, 42. Another sensor 13 is secured to a net device 7 for sensing the hitting or striking of the ball onto the net device 7. When the ball strike or hit onto the tables 41, 42 and onto the net device 7, vibrations and shocks may be generated and may be sensed by the sensors 11, 12, 13. A central processing unit (CPU) is electrically coupled to the sensors 11, 12, 13 and includes an amplifier device 20 for amplifying the sound wave received by the sensors 11, 12, includes a rectifyer device 21 for rectifying the amplified sound wave, and includes an identify device 22 for identifying the sound wave. A displayer device 3 is coupled to the CPU for displaying the scores. The paddle for the table tennis games normally includes a resilient pad for engaging with the ball, such that almost no vibrations will be generated and sensed by the sensors 11, 12, 13. Vibrations and shocks may be generated only when the ball strikes or hits onto the table surface or onto the net device 7.

The displayer device 3 includes two displayer screens 30 for displaying the scores of the players and another two displayer screens 31 for displaying the number of balls to be served by the players. For example, shown in FIG. 1, the displayer device 3 shows that the scores of the two players are 13:12; and the first player has five balls to be served. The displayer device 3 includes one or more press buttons 32 for initializing or for calibrating the displayer screens 30, 31.

Figure 3:
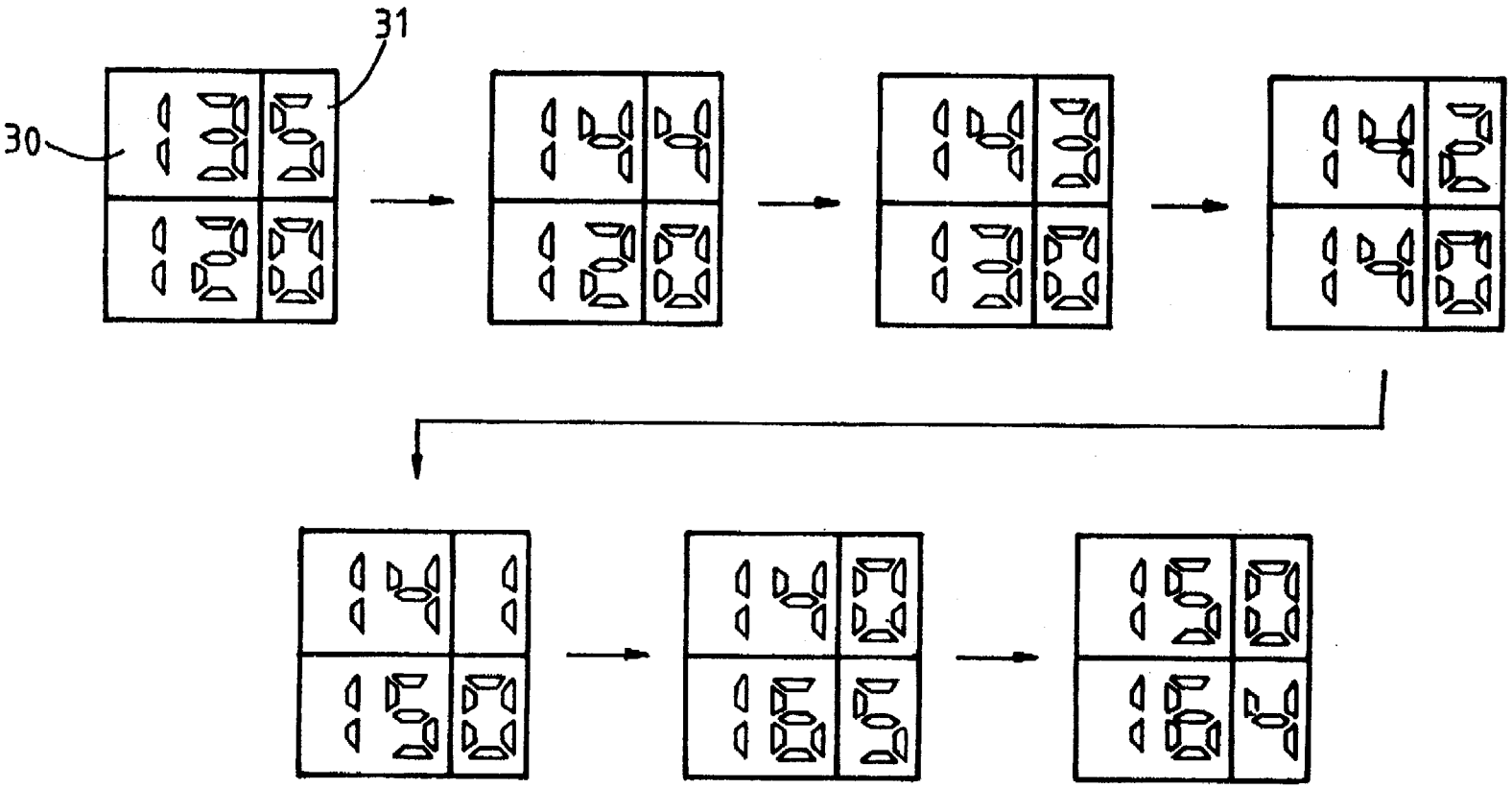
FIG. 3 is a schematic view illustrating the front portion of the score displayer device.

Referring next to FIG. 3, for example, the displayer screens 30, 31 located on the portion of the displayer device 3 are faced toward the first player and may be seen by the first player. The upper left displayer screen 30 shows the score of the first player and the lower left screen shows the score of the second player. The upper right displayer screen 31 shows five balls to be served by the first player. The number of the balls to be served by the first player will be decreased to zero. When the upper right displayer screen 31 is decreased to zero, the lower right displayer screen will show five balls to be served by the second player.

Figure 4:
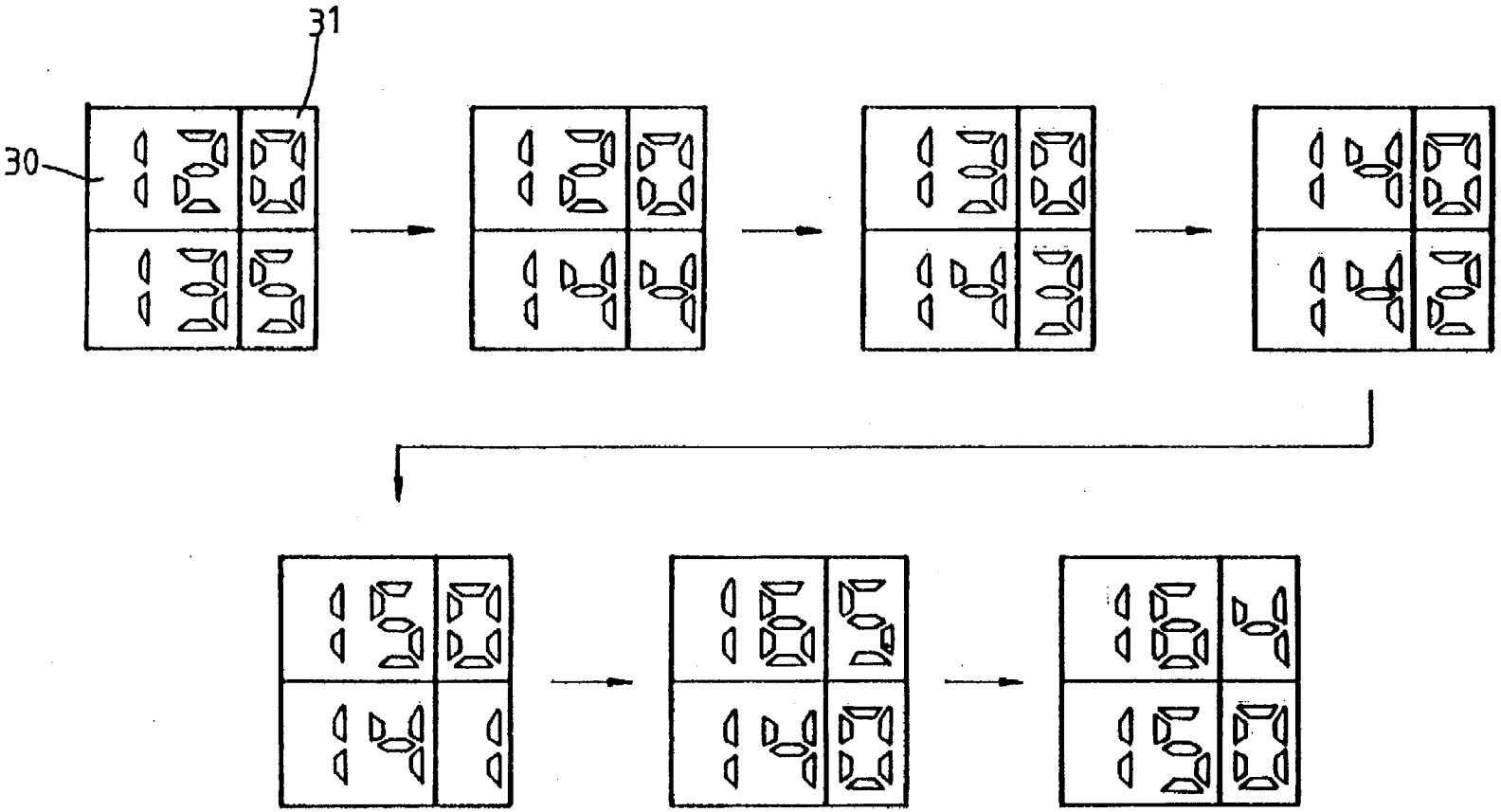
FIG. 4 is a schematic view illustrating the rear portion of the score displayer device.

On the contrary, as shown in FIG. 4, the displayer screens 30, 31 located on the rear portion of the displayer device 3 are faced toward the second player and may be seen by the second player. The upper left displayer screen 30 shows the score of the second player and the lower left screen shows the score of the first player. The lower right displayer screen 31 shows five balls to be served by the first player. The number of the balls to be served by the first player will be decreased to zero. When the lower right displayer screen 31 is decreased to zero, the upper right displayer screen will show five balls to be served by the second player.

When the ball strikes the first table 41 and the second table 42 and does not strike the first table 41 again for about two to five seconds, then the first player standing beside the first table 41 obtains one point. When the ball strikes the first table 41, the net device 7 and then strikes the second table 42, the scores are not changed and the serving person should serve the ball again. However, when the ball does not strike any of the tables 41, 42 and the net device 7, the scores in the displayer screens 30, 31 may be calibrated or adjusted by the press buttons 32 and by the players.

Alternatively, the displayer device 3 may include a single displayer screen for showing the scores of the players in turn or alternatively.

Accordingly, the table tennis automatic scoring apparatus in accordance with the present invention may automatically score the table tennis games.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A table tennis scoring apparatus comprising:

three sensors for securing to two tables and a net device of the table tennis game respectively and for sensing a striking of a table tennis ball to the tables and to the net device, a processing means coupled to said sensors for processing signals from said sensors, and a displayer means coupled to said processing means for displaying a score of the table tennis game.

2. A scoring apparatus according to claim 1, wherein said processing means includes an amplifier device for amplifying the signals from said sensors and includes a rectifyer device for rectifying the amplified signals, and includes an identify device for identifying the rectified signals.

3. A scoring apparatus according to claim 1, wherein said displayer means includes a first displayer screen for displaying the score of a first player and includes a second displayer screen for displaying the score of a second player.

4. A scoring apparatus according to claim 3, wherein said displayer means further includes a third displayer screen for displaying a number of balls to be served.

5. A scoring apparatus according to claim 3, wherein said displayer means further includes at least one press button for calibrating said first and said second displayer screens.

* * * * *